US007484826B2

(12) United States Patent
Hiroki et al.

(10) Patent No.: US 7,484,826 B2
(45) Date of Patent: Feb. 3, 2009

(54) METHOD AND APPARATUS FOR FORMING IMAGE

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 36 days.

(21) Appl. No.: 11/619,714

(22) Filed: Jan. 4, 2007

(65) Prior Publication Data

US 2008/0165215 A1 Jul. 10, 2008

(51) Int. Cl.
*B41J 2/165* (2006.01)

(52) U.S. Cl. ..... 347/22; 347/32; 347/33

(58) Field of Classification Search ..... 347/14, 347/22, 29, 32, 35, 37, 33
See application file for complete search history.

(56) References Cited

U.S. PATENT DOCUMENTS 5,949,443 A * 9/1999 Yamamoto et al. ..... 347/3
6,390,595 B1 * 5/2002 Kusumi ..... 347/33
6,886,907 B1 * 5/2005 Okamoto et al. ..... 347/33
2008/0165218 A1 7/2008 Hiroki et al.
2008/0165220 A1 7/2008 Hiroki et al.
2008/0165231 A1 7/2008 Hiroki et al.
2008/0165236 A1 7/2008 Hiroki et al.
2008/0165238 A1 7/2008 Hiroki et al.
2008/0165239 A1 7/2008 Hiroki et al.
2008/0165240 A1 7/2008 Hiroki et al.
2008/0165241 A1 7/2008 Hiroki et al.
2008/0165242 A1 7/2008 Hiroki et al.

FOREIGN PATENT DOCUMENTS

JP 2005-161816 6/2005

* cited by examiner

*Primary Examiner*—Trinh H Nguyen
(74) *Attorney, Agent, or Firm*—Amin, Turocy & Calvin, LLP

(57) ABSTRACT

An image forming apparatus includes an apparatus body, a conveying mechanism that is provided in this apparatus body and conveys a sheet, a recording head that moves along a moving path orthogonal to a conveying direction of the sheet, ejects an ink to the sheet to print an image on the sheet, and, after the printing is finished, stands by in a first standby position on one end side of the moving path, and a CPU that moves the recording head that is on standby in the first standby position to an arbitrary position of the moving path.

20 Claims, 7 Drawing Sheets

METHOD AND APPARATUS FOR FORMING IMAGE

BACKGROUND OF THE INVENTION

1. Field of the Invention

The present invention relates to an image forming apparatus for printing an image on a medium such as a print sheet, and, more particularly to an image forming apparatus that has a recording head of an ink-jet system and an image forming method.

2. Description of the Related Art

As this type of an image forming apparatus, there is known an image forming apparatus that has a conveying path for conveying a sheet in an apparatus body thereof and ejects an ink from a recording head to the sheet conveyed by this sheet conveying path to form an image on the sheet.

The recording head ejects the ink while moving along a head moving path orthogonal to a conveying direction of the sheet. One end side of the head moving path is a standby position of the recording head. As disclosed in, for example, JP-A-2005-161816, a cleaning unit is provided near this standby position. The cleaning unit includes a cap that sucks an excess ink on an orifice surface of the recording head and a blade that cleans the orifice surface of the recording head.

At the time of a printing operation, ink mist is generated around the recording head and the cleaning unit is stained by this ink mist.

Thus, conventionally, the cleaning unit is cleaned periodically.

However, conventionally, since the cleaning unit is arranged near the standby position where the recording head is on standby, there is a problem in that it is difficult to perform cleaning work for the cleaning unit because the recording head interferes with the work.

BRIEF SUMMARY OF THE INVENTION

An aspect of the invention has been devised in view of such a point and it is an object of the invention to provide an image forming apparatus and an image forming method that make it possible to clean a cleaning unit without being interfered by a recording head.

An image forming apparatus according to the aspect of the invention includes an apparatus body, a conveying device that is provided in this apparatus body and conveys a medium, a recording device that moves along a moving path orthogonal to a conveying direction of the medium, ejects an ink to the medium to print an image on the medium, and, after the printing is finished, stands by in a first standby position on one end side of the moving path, and a control device that moves the recording device that is on standby in the first standby position to an arbitrary position of the moving path.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the invention will be hereinafter explained in detail with reference to the drawings.

Figure 1:
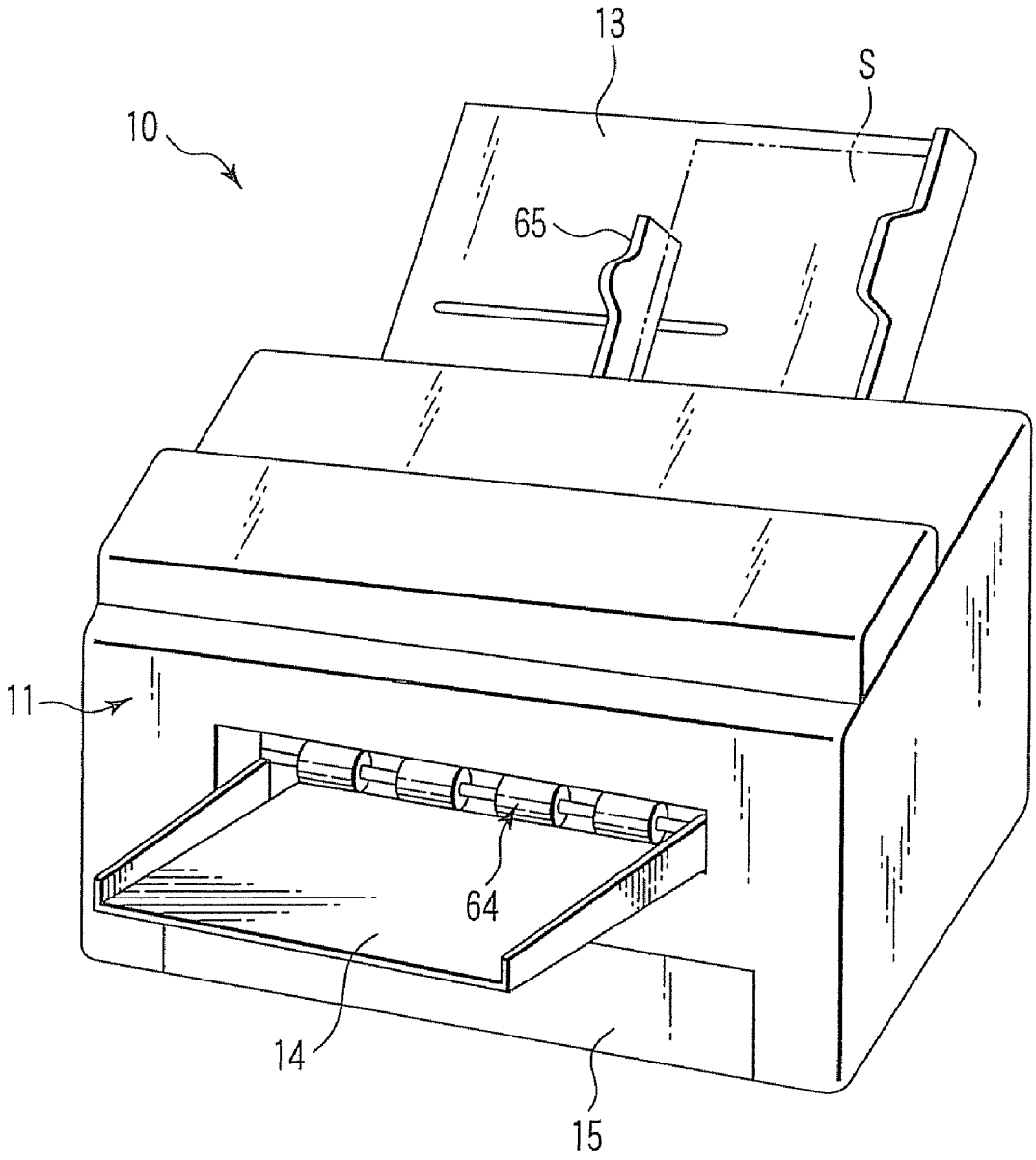
FIG. 1 is an external perspective view showing an image forming apparatus according to a first embodiment of the invention.

FIG. 1 is an external perspective view showing an image forming apparatus according to a first embodiment of the invention.

An image forming apparatus 10 includes an apparatus body 11. A first feed tray 13 is disposed on a rear side of this apparatus body 11, a discharge tray 14 is disposed on a front side of the apparatus body 11, and a second feed tray 15 is provided on a lower side of the apparatus body.

Figure 2:
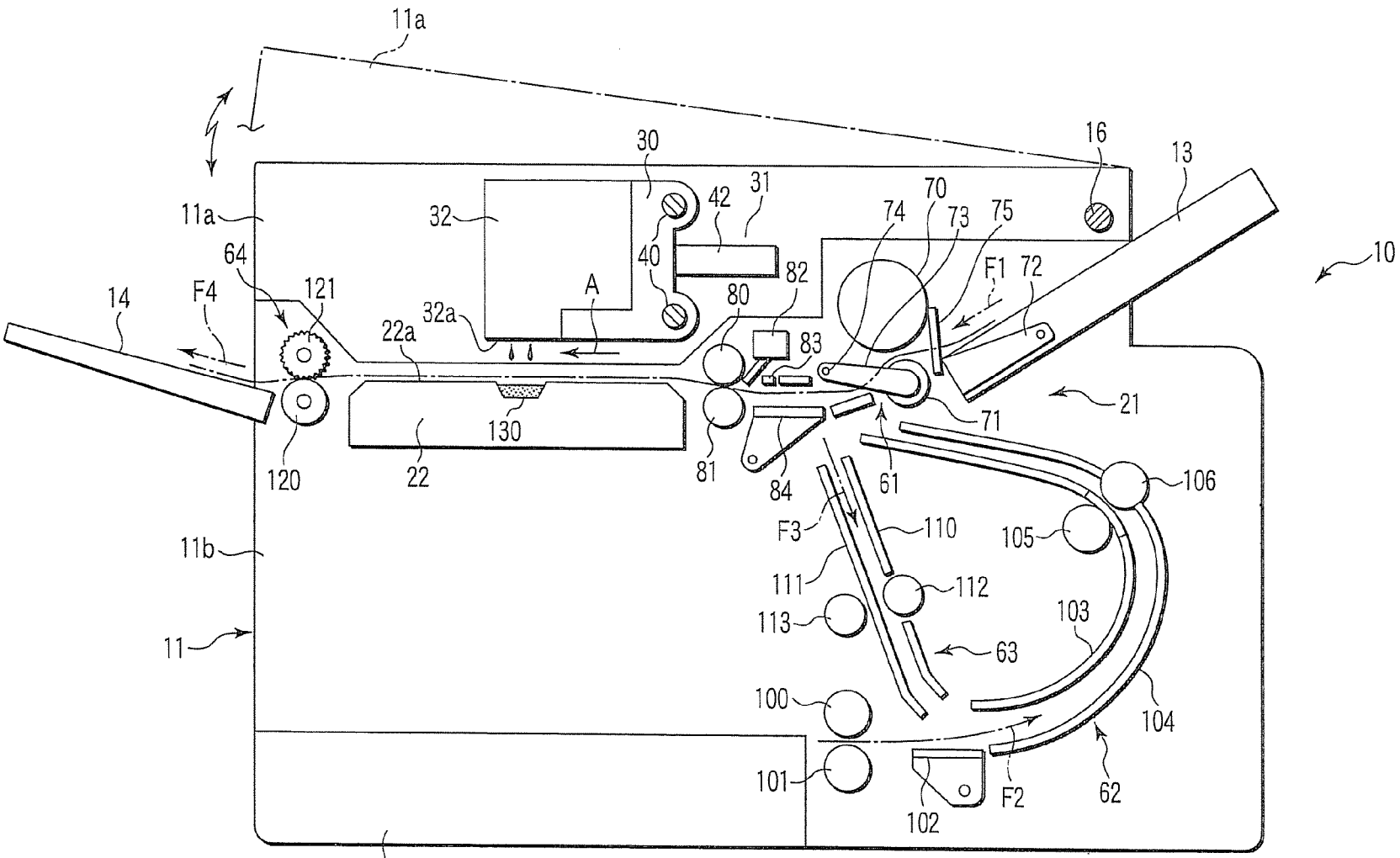
FIG. 2 is a diagram showing an internal structure of the image forming apparatus in FIG. 1.

FIG. 2 schematically shows an internal structure of the image forming apparatus 10.

The apparatus body 11 is constituted by upper and lower housings 11*a* and 11*b*. The upper housing 11*a* is rotatably attached to the lower housing 11*b* via a supporting shaft 16 and opened and closed around the supporting shaft 16.

Figure 3:
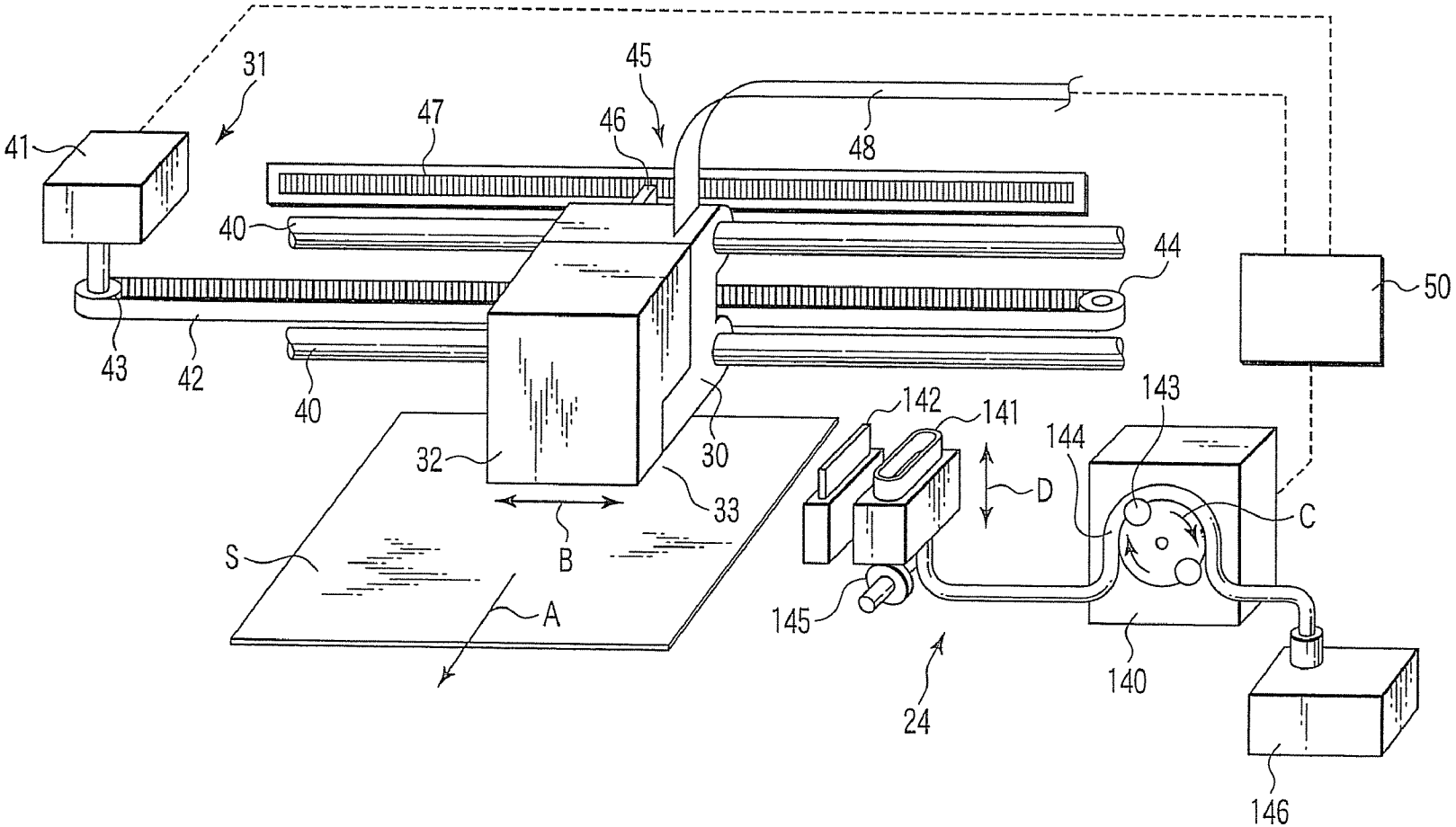
FIG. 3 is a perspective view showing a moving mechanism and a cleaning mechanism for a recording head in FIG. 2.

The apparatus body 11 includes a sheet conveying mechanism 21 serving as a conveying device, a sheet guide 22 serving as a media guide that has a guide surface 22*a* in the horizontal direction, and a first head cleaning mechanism 24 shown in FIG. 3. The sheet guide 22 and the head cleaning mechanism 24 will be explained in detail later.

On an upper side of the sheet guide 22, a carriage 30, a carriage driving mechanism 31 for driving this carriage 30, a recording head 32 serving as a recording device of an ink-jet system mounted on the carriage 30, and the like are arranged. A replaceable ink cartridge (not shown) is housed in the recording head 32.

As shown in FIG. 2, the recording head 32 has a nozzle section 32*a* opposed to the guide surface 22*a* of the sheet guide 22 and an ink ejecting mechanism (not shown) that ejects an ink from this nozzle section 32*a*. The recording head 32 forms an image on a sheet S (shown in FIG. 3) with this ink. An arrow A in FIG. 3 indicates a conveying direction of the sheet S.

An example of the ink ejecting mechanism is a thermal type. The thermal type applies heat to the ink with a heater built in the recording head 32 to film-boil the ink. A pressure change is caused in the ink by growth or contraction of air bubbles due to this film boiling. An image is formed on the sheet S by ejecting the ink from the nozzle section 32*a* according to this pressure change. Other than the thermal type, for example, an ink ejecting mechanism that uses an element (e.g., a piezoelectric element) having a piezoelectric effect may be adopted. For example, the piezoelectric element is deformed by an electric current and an ink is ejected from a nozzle section according to a pumping action based on the deformation.

As shown in FIG. 3, the carriage driving mechanism 31 includes a carriage guide 40 extending in the horizontal direction, a motor 41 such as a stepping motor, power transmitting members such as a timing belt 42 and sprockets 43 and 44, and a sensor unit 45 for controlling a position of the carriage 30. The carriage guide 40 extends in a direction B orthogonal to the conveying direction of the sheet S. The carriage guide 40 is supported by a frame of the apparatus body 11.

The recording head 32 is reciprocatingly moved in the arrow B direction together with the carriage 30 along the carriage guide 40 and along a head moving path 33 orthogonal to the conveying direction of the sheet S.

The rotation of the motor 41 is transmitted to the carriage 30 via the timing belt 42. Therefore, the recording head 32 reciprocatingly moves along the carriage guide 40. The sensor unit 45 for controlling a position of the carriage 30 includes, for example, an encoder sensor 46 and a ladder plate 47 serving as a section to be detected. The ladder plate 47 extends in a direction parallel to the carriage guide 40. The ladder plate 47 has a ladder pattern formed at equal pitches. The ladder pattern of the ladder plate 47 is optically detected by the encoder sensor 46 according to the position of the carriage 30, whereby the position of the carriage 30 is detected. A signal of the position detected is inputted to a control unit 50 via a flexible harness 48.

As shown in FIG. 2, the sheet conveying mechanism 21 includes a first conveying unit 61, a second conveying unit 62, a duplex-printing conveying unit 63 used in performing duplex printing, and a discharging mechanism 64.

The first conveying unit 61 conveys a sheet taken out from the first feed tray 13 to the recording head 32. The second conveying unit 62 conveys a sheet taken out from the second feed tray 15 to the recording head 32. The discharging mechanism 64 has a function of discharging a sheet having an image printed thereon onto the discharge tray 14.

It is possible to place plural sheets (e.g., print sheets) on the first feed tray 13 stacking the sheets in the thickness direction. As shown in FIG. 1, a movable guide 65 is provided in the first feed tray 13. The movable guide 65 is movable in the width direction of the sheet S according to a size of the sheet S. It is possible to regulate a position in the width direction of the sheet S on the first feed tray 13 by moving the movable guide 65 in the width direction of the sheet S.

The first conveying unit 61 includes a feed roller 70, a separation roller 71 located below the feed roller 70, and a separation unit 72 including a separation pad. The feed roller 70 feeds a sheet taken out from the lower end of the first feed tray 13 to the recording head 32. A torque limiter is provided in the separation roller 71. The separation roller 71 rotates in a direction identical with a direction of rotation of the feed roller 70 according to a function of the torque limiter when only one sheet is present between the separation roller 71 and the feed roller 70. When two or more sheets are present between the feed roller 70 and the separation roller 71, the separation roller 71 rotates in a direction opposite to the direction of rotation of the feed roller 70. Therefore, when plural sheets are taken out from the first feed tray 13 and fed into a space between the feed roller 70 and the separation roller 71, an uppermost sheet and the other sheets are separated and only the uppermost sheet is fed to the recording head 32. A sheet separating mechanism for taking out sheets from the first feed tray 13 one by one is constituted by the feed roller 70, the separation roller 71, the separation unit 72, and the like.

The separation roller 71 is held by a holder 73. The holder 73 is movable in the up-to-down direction around a shaft 74 extending in the horizontal direction. The separation roller 71 is brought into contact with the feed roller 70 at a predetermined load by a spring and separated from the feed roller 70 by a not-shown cam. It is possible to move the separation unit 72 in a direction toward and away from the feed roller 70 with a not-shown cam.

After the sheet is fed, the separation roller 71 and the separation unit 72 are separated from the feed roller 70, moved to standby positions, and put on standby until the next sheet feed time, respectively. A return lever 75 is rotatably arranged near the lower end of the first feed tray 13. When the sheet taken out from the first feed tray 13 is conveyed to the feed roller 70, the return lever 75 is retracted by a spring to a position where the return lever 75 does not hinder the conveyance of the sheet. This return lever 75 rotates in synchronization with the movement of the separation roller 71 and the separation unit 72 to the standby positions and feeds a remaining sheet back to the first feed tray 13.

The first conveying unit 61 includes a conveying roller 80, a pinch roller 81 opposed to this conveying roller 80, a sheet sensor 82, a media sensor 83, and a switching member 84. The conveying roller 80 feeds a sheet to a space between the sheet guide 22 and the recording head 32. The sheet sensor 82 has a sensor arm that is capable of detecting positions of the leading end and the trailing end of the sheet.

The media sensor 83 has a function of detecting a quality (e.g., paper quality) of a sheet. For example, when the surface of the sheet is made of a material having moisture-absorption characteristics, the media sensor 83 outputs a signal for increasing a quantity of ink ejected from the recording head 32 to the control unit 50. In the case of a sheet having glossiness on the surface thereof, for example, coat paper, the media sensor 83 performs control for outputting a signal for reducing a quantity of ink ejected from the recording head 32 to the control unit 50. In the case of color printing, a ratio of ejection of plural color elements may be adjusted on the basis of a signal from the media sensor 83.

Figure 4:
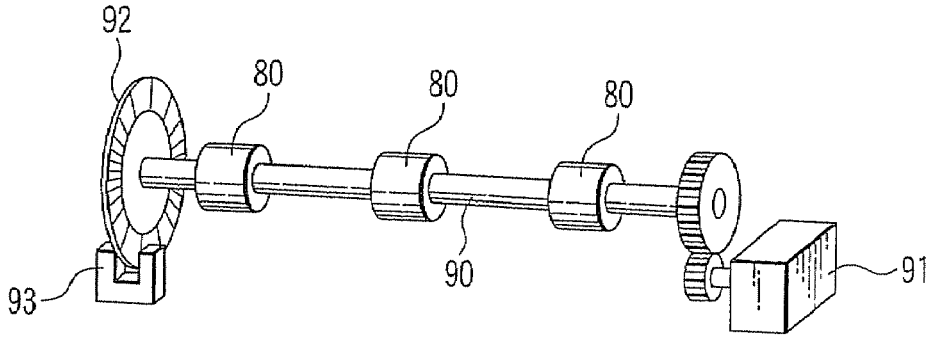
FIG. 4 is a perspective view showing a driving mechanism for a conveying roller in FIG. 2.

As shown in FIG. 4, the conveying roller 80 is attached to a shaft 90. The shaft 90 is rotated by a controllable motor 91 such as a stepping motor. The pinch roller 81 opposed to the conveying roller 80 is set in contact with the conveying roller 80 by a not-shown spring. A ladder wheel 92 of a disc shape is attached to the shaft 90 of the conveying roller 80. A ladder pattern is formed in a circumferential direction at fixed pitches in the ladder wheel 92. This ladder wheel 92 is detected by a sensor 93 and inputted to the control unit 50. Consequently, the rotation of the conveying roller 80 is controlled and conveyance of a sheet is controlled at the time of image formation.

A sheet taken out from the first feed tray 13 by the feed roller 70 is conveyed to a space between the conveying roller 80 and the pinch roller 81 through the first conveying unit 61 as indicated by an arrow F1 in FIG. 2. The leading end of the sheet is detected by the sheet sensor 82 and positioning for image formation is performed. This sheet passes between the upper surface (the guide surface 22*a*) of the sheet guide 22 and the recording head 32 according to the rotation of the conveying roller 80. When the sheet passes, an image is formed on the sheet S by the recording head 32. Ribs functioning as a conveyance reference surface are formed on the guide surface 22*a* of the sheet guide 22. These ribs keep the height of the sheet proper and prevent the sheet from heaving. The sheet having the image formed thereon is conveyed to the discharging mechanism 64.

The second conveying unit 62 includes rollers 100 and 101 for taking out a sheet from the second feed tray 15 of a cassette type, a switching member 102, guide members 103 and 104 for guiding the sheet taken out, a conveying roller 105 provided along the guide members 103 and 104, and a pinch roller 106 opposed to the conveying roller 105. The pinch roller 106 is pressed against the conveying roller 105 by a spring. It is possible to store plural sheets (e.g., print sheets) in the second feed tray 15 stacking the sheets in the thickness direction. The rollers 100 and 101 of the second conveying unit 62 function as sheet separating mechanisms for taking out sheets from the second feed tray 15 one by one.

A sheet taken out from the second feed tray 15 passes between the guide members 103 and 104 of the second conveying unit 62 through the switching member 102 as indicated by an arrow F2 in FIG. 2. This sheet is further conveyed to the conveying roller 80 by the rollers 105 and 106 and fed to the space between the recording head 32 and the sheet guide 22.

The duplex-printing conveying unit 63 includes guide members 110 and 111, a conveying roller 112 provided along the guide members 110 and 111, and a pinch roller 113 opposed to the conveying roller 112. The pinch roller 113 is pressed against the conveying roller 112 by a spring. The guide members 110 and 111 are arranged between the switching member 84 of the first conveying unit 61 and the switching member 102 of the second conveying unit 62. At the time of duplex printing, a sheet is fed in an arrow F3 direction in FIG. 2. The conveying rollers 80, 105, and 112 are obtained by providing rubber-like resin such as EPDM (ethylene propylene diene rubber) on a metal shaft and have a function of conveying the sheet S with friction.

When duplex printing is performed, after an image is printed on one side of a sheet by the recording head 32, the trailing end of this sheet is detected by the sheet sensor 82. Immediately after the detection, the conveying roller 80 rotates reversely and a position of the switching member 84 is switched. Consequently, the sheet is sent to the duplex printing conveying unit 63 as indicated by the arrow F3 in FIG. 2. Moreover, this sheet is conveyed by the rollers 112 and 113 and passes between the guide members 103 and 104 of the second conveying unit 62 through the switching member 102. In this way, the front and the back of the sheet are reversed and this sheet is sent to the recording head 32 again by the conveying roller 80, whereby an image is printed on the other side of the sheet.

The discharging mechanism 64 has a discharge roller 120, a star wheel 121, a transmitting mechanism (not shown) for transmitting the rotation of the conveying roller 80 to the discharge roller 120 and the star wheel 121, and the like. The star wheel 121 is a wheel of a gear shape made of a thin plate of stainless steel or the like. A sheet having an image printed thereon by the recording head 32 is conveyed in a direction indicated by an arrow F4 to the discharge tray 14 while being pressed against the discharge roller 120 by the star wheel 121. The sheet after printing is prevented from floating from the discharge roller 120 by this star wheel 121.

Figure 5:
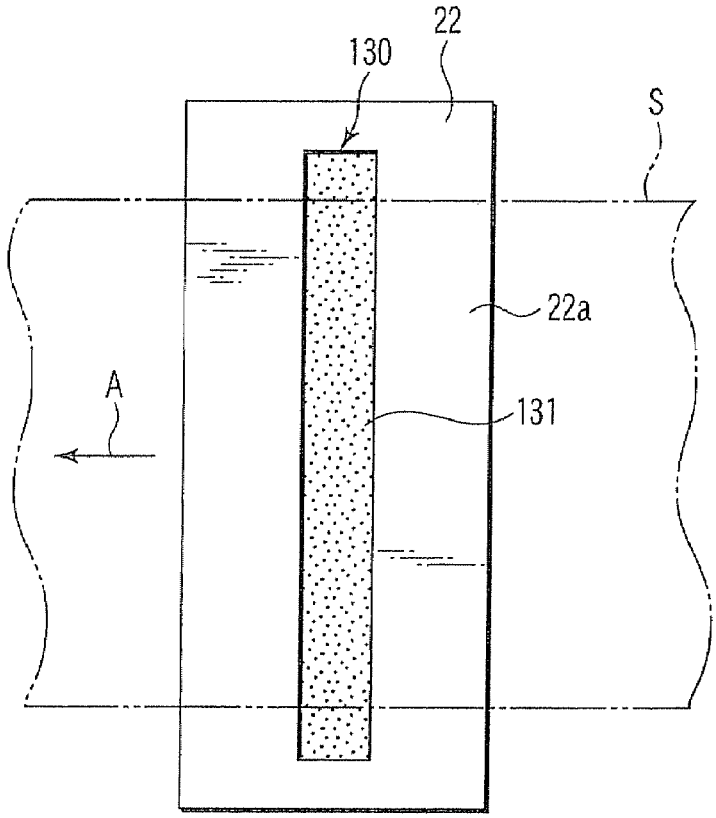
FIG. 5 is a plan view showing a sheet guide in FIG. 2.

As shown in FIG. 5, an ink absorbing section 130 is formed on the upper surface side of the sheet guide 22. This ink absorbing section 130 is opposed to the nozzle section 32*a* (shown in FIG. 2) of the recording head 32 and formed in a position lower than the guide surface 22*a*. The width of the ink absorbing section 130 is larger than the width of the sheet S. For example, a sponge-like ink absorbing member 131 is housed in this ink absorbing section 130. When rimless printing on a sheet is performed, an excess ink ejected on the outside of the edge of the sheet is absorbed by this ink absorbing member 131, whereby following sheets are prevented from being stained.

Figure 7:
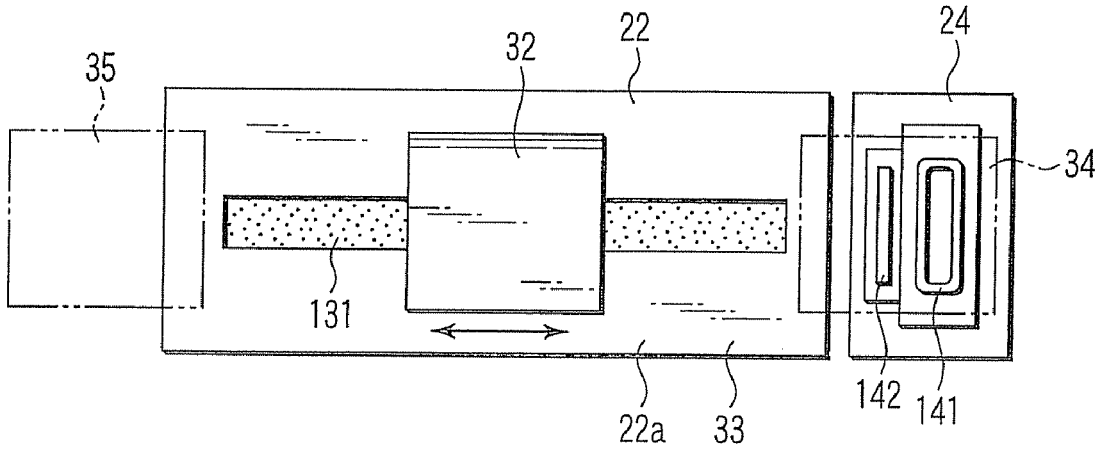
FIG. 7 is a diagram showing a standby position of the recording head in FIG. 2.

The first head cleaning mechanism 24 shown in FIG. 3 includes a suction pump 140 for performing cleaning of the recording head 32, a cap 141 for preventing the recording head 32 from drying, and a blade member 142 for cleaning the nozzle section 32*a* of the recording head 32. As shown in FIG. 7, the cap 141 and the blade member 142 are disposed near the first standby position on the one end side of the moving path of the recording head 32.

An example of the suction pump 140 strokes a tube 144 in a direction indicated by an arrow C with a body of rotation 143 to generate a negative pressure on the inner side of the cap 141.

It is possible to move the cap 141 in an up-to-down direction (an arrow D direction in FIG. 3) with a driving mechanism 145. The driving mechanism 145 moves the cap 141 up and down with an electric actuator 146 such as a solenoid as a driving source. The rotation of a motor may be converted into a linear motion by a cam, a link mechanism, or the like to move the cap 141 up and down. In maintaining the recording head 32, the cap 141 is lifted to the recording head 32 to bring the cap 141 into close contact with the recording head 32. In this state, the suction pump 140 is actuated to suck an excess ink adhering to the nozzle section 32*a* of the recording head 32. The waste ink sucked is discharged into a waste ink tank 146. Thereafter, the cap 141 moves away from the recording head 32 and the nozzle section 32*a* of the recording head 32 is cleaned by the blade member 142.

Figure 6:
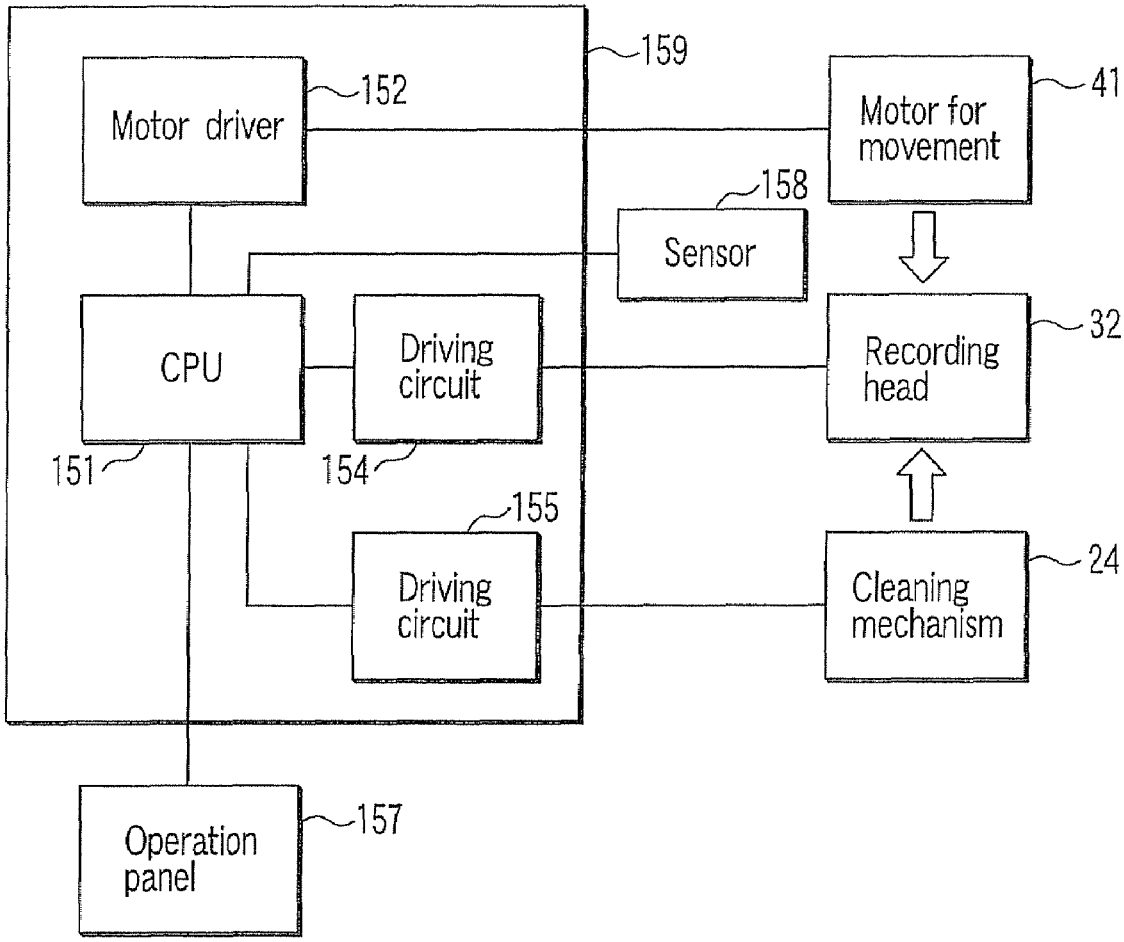
FIG. 6 is a block diagram showing a driving control system for a recording head in FIG. 2.

FIG. 6 is a circuit diagram showing a driving system for the recording head 32.

Reference numeral 159 in the figure denotes a control board. A CPU 151 serving as a control device is provided in this control board 159. A motor for movement 41, which rotates normally and reversely, is connected to the CPU 151 via a motor driver 152. Further, the recording head 32 is connected to the CPU 151 via a driving circuit 154 and the cleaning mechanism 24 is connected to the CPU 151 via a driving circuit 155. Moreover, an operation panel 157 serving as an instructing unit for instructing a switching operation of the normal and reverse rotations of the motor for movement 41 is connected to the CPU 151 and a detection sensor 158 for detecting a position of the recording head 32 is connected to the CPU 151.

As shown in FIG. 7, one end side of the head moving path 33 is a first standby position 34 where the recording head 32 is put on standby and the other end side of the head moving path 33 is a second standby position 35.

The CPU 141 moves, as shown in FIG. 7, the recording head 32 to an ink replacement position, i.e., substantially the center of the head moving path 33 on the basis of an opening operation for the upper housing 11*a* of the apparatus body 11.

Figure 8:
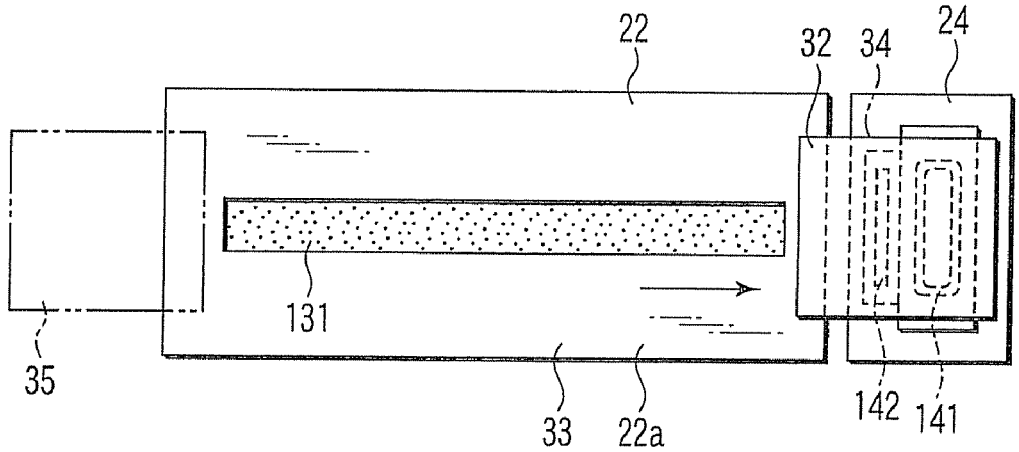
FIG. 8 is a diagram showing a state in which the recording head in FIG. 2 is put on standby in a first standby position.

The CPU 141 moves, as shown in FIG. 8, the recording head 32 to the first standby position 34 on the basis of a closing operation for the upper housing 11*a* of the apparatus body 11.

Moreover, the CPU 141 reciprocatingly moves, in a state in which the upper housing 11*a* of the apparatus body 11 is opened, the recording head 32 between the first standby position 34 and the second standby position 35 every time the operation panel 157 is operated.

At the time of the printing operation, since an ink is ejected from the recording head 32 and ink mist is generated around the recording head 32, the sheet guide 22 and the cleaning mechanism 24 are stained by the ink mist. Therefore, it is necessary to periodically clean the sheet guide 22 and the cleaning mechanism 24.

A method of cleaning the sheet guide 22 and the cleaning mechanism 24 will be explained.

First, in this case, a user opens the upper housing 11*a* of the apparatus body 11. Consequently, as shown in FIG. 7, the recording head 32 moves to the ink replacement position substantially in the center of the head moving path 33. The user subjects the operation panel 157 to press operation from this state. According to this press operation, as shown in FIG. 8, the recording head 32 moves to the one end side of the head moving path 33 and stands by in the first standby position 34. After putting the recording head 32 on standby in the first standby position 34, the user performs cleaning of the sheet guide 22. In this case, it is possible to satisfactorily clean most of the sheet guide 22.

However, since the one end side of the sheet guide 22 and the cleaning mechanism 24 are located in an area near the recording head 32 that is on standby in the first standby position 34, it is difficult to clean the one end side of the sheet guide 22 and the cleaning mechanism 24 because the recording head 32 interferes with the cleaning.

Figure 9:
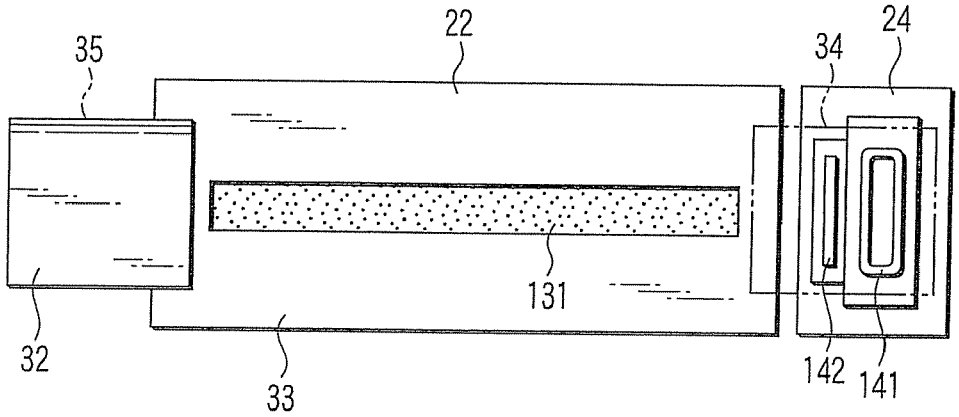
FIG. 9 is a diagram showing a state in which the recording head in FIG. 2 is put on standby in a second standby position.

Thus, in this case, the user subjects the operation panel 157 to press operation again. According to this press operation, as shown in FIG. 9, the recording head 32 moves to the other end side of the head moving path 33 and stands by in the second standby position 35. Consequently, since the one end side of the sheet guide 22 and the cleaning mechanism 24 are exposed, it is possible to easily perform cleaning of the one end side of the sheet guide 22 and the cleaning mechanism 24.

After finishing the cleaning, the user closes the upper housing 11*a*. Consequently, as shown in FIG. 8, the recording head 32 moves to and stands by in the first standby position 34 on the one end side of the head moving path 33 again.

According to this embodiment, when the one end side of the sheet guide 22 and the cleaning mechanism 24 in the area near the recording head 32 that is on standby in the first standby position 34 are cleaned, since the recording head 32 is retracted from the first standby position 34, it is possible to easily perform cleaning work for the one end side of the sheet guide 22 and the cleaning mechanism 24.

When the upper housing 11*a* is closed, since the recording head 32 returns to the first standby position 34 from the second standby position 35 and the surface of the recording head 32 is covered by the cap 141 of the cleaning mechanism 24, it is also possible to prevent an ink from drying.

Figure 10:
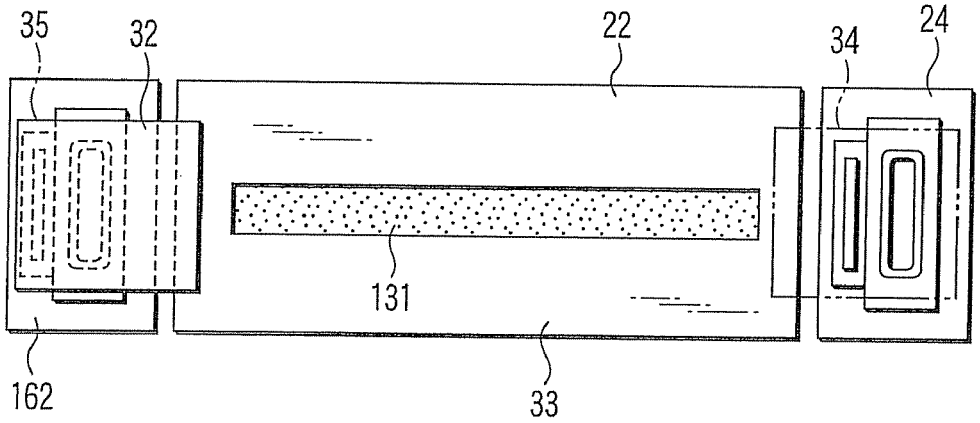
FIG. 10 is a diagram showing an arrangement of a cleaning mechanism according to a second embodiment of the invention.

FIG. 10 shows a second embodiment of the invention.

In this second embodiment, a second cleaning mechanism (constituted the same as the first cleaning mechanism 24) 162 is provided not only on one end side of the head moving path 33 but also on the other end side.

When the recording head 32 is put on standby in the second standby position 35 on the other end side of the head moving path 33, the surface of the recording head 32 is covered by the cap 141 of the cleaning mechanism unit 162.

According to this second embodiment, there is an advantage that, even when the recording head 32 is retracted from the first standby position 34, it is possible to surely prevent an ink on the surface of the recording head 32 from drying.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming method comprising:

conveying a medium with conveying means in an apparatus body;

moving recording means along a moving path orthogonal to a conveying direction of the medium, ejecting an ink from this recording means to the medium to print an image on the medium, and, after this printing is finished, moving the recording device to a first standby position on one end side of the moving path to put the recording means on standby; and moving the recording means to an arbitrary position of the moving path at the time of cleaning of a neighborhood of the recording means that is on standby in the first standby position.

2. An image forming method according to claim 1, wherein the other end side of the moving path of the recording means is set as a second standby position.

3. An image forming method according to claim 2, wherein the recording means is moved from the first standby position to the second standby position or from the second standby position to the first standby position.

4. An image forming method according to claim 1, wherein a surface of the recording means that is on standby in the second standby position is covered by a cap provided near the second standby position.

5. An image forming method according to claim 1, wherein the apparatus body is constituted to be freely opened and closed, and the recording means is moved to the first standby position on the basis of closing of this apparatus body.

6. An image forming apparatus comprising:

an apparatus body which includes an upper housing capable of being opened and closed;

a conveying device which is provided in the apparatus body and conveys a medium;

a recording device which moves along a moving path orthogonal to a direction of conveying the medium, ejects ink to the medium to print an image on the medium, and stands by in a first standby position located on one end side of the moving path after printing the image;

a cleaning device which is provided near the first standby position and cleans the recording device standing by in the first standby position; and a control device which controls the recording device so that the recording device moves to the first standby position upon opening of the upper housing, moves to a second standby position located on the other end side of the moving path at the time of cleaning the cleaning device, and moves to the first standby position when the cleaning device has been cleaned and the upper housing is closed.

7. The image forming apparatus according to claim 6, comprising an instructing unit which instructs the control device to move the recording device from the first standby position to the second standby position or from the second standby position to the first standby position.

8. The image forming apparatus according to claim 6, comprising a cap which is provided near the second standby position and covers the recording device standing by in the second standby position.

9. The image forming apparatus according to claim 6, wherein a substantial center of the moving path is an ink replacement position for replacing the ink of the recording device, and the control device controls the recording device so that the recording device moves to the ink replacement position upon the opening of the upper housing.

10. An image forming apparatus comprising: an apparatus body which includes an upper housing capable of being opened and and closed;

a conveying means provided in the apparatus body for conveying a medium;

a recording means for moving along a moving path orthogonal to a direction of conveying the medium, ejecting ink to the medium to print an image on the medium and standing by in a first standby position located on one end side of the moving path after printing the image;

a cleaning means provided near the first standby position for cleaning the recording means standing by in the first standby position; and a control means for controlling the recording means so that the recording means moves to the first standby position upon the opening of the upper housing, moves to a second standby position located on the other end side of the moving path at the time of cleaning the cleaning means, and moves to the first standby position when the cleaning means has been cleaned and the upper housing is closed.

11. The image forming apparatus according to claim 10, comprising an instructing unit which instructs the control means to move the recording means from the first standby position to the second standby position or from the second standby position to the first standby position.

12. The image forming apparatus according to claim 10, comprising a cap which is provided near the second standby position and covers the recording means standing by in the second standby position.

13. The image forming apparatus according to claim 10, wherein a substantial center of the moving path is an ink replacement position for replacing the ink of the recording means, and the control means controls the recording means so that the recording means moves to the ink replacement position upon the opening of the upper housing.

14. An image forming method comprising:

conveying a medium by use of a conveying device which is provided in an apparatus body including an upper housing capable of being opened and closed;

moving a recording device along a moving path orthogonal to a direction of conveying the medium, ejecting ink from the recording device to the medium to print an image on the medium, and causing the recording device to stand by in a first standby position located on one end side of the moving path after printing the image;

cleaning the recording device standing by in the first standby position by use of a cleaning device provided near the first standby position; and moving the recording device to the first standby position upon the opening of the upper housing, cleaning the cleaning device while moving and keeping the recording device in a second standby position located on the other end side of the moving path, and moving the recording device to the first standby position when the cleaning device has been cleaned and the upper housing is closed.

15. The image forming method according to claim 14, wherein the recording device is moved from the first standby position to the second standby position or from the second standby position to the first standby position in accordance with instruction from an instructing unit.

16. The image forming method according to claim 14, wherein the recording device standing by in the second standby position is covered with a cap provided near the second standby position.

17. An image forming method according to claim 16, wherein a surface of the recording device that is on standby in the second standby position is covered by a cap provided near the second standby position.

18. An image forming method according to claim 16, wherein the apparatus body is constituted to be freely opened and closed, and the recording device is moved to the first standby position on the basis of closing of this apparatus body.

19. The image forming method according to claim 14, wherein the recording device is moved to the ink replacement position located in a substantial center of the moving path, upon the opening of the upper housing.

20. An image forming method according to claim 19, wherein the recording device is moved from the first standby position to the second standby position or from the second standby position to the first standby position.

* * * * *